US010731675B2

(12) United States Patent
Litschko

(10) Patent No.: US 10,731,675 B2
(45) Date of Patent: Aug. 4, 2020

(54) METHOD AND DEVICE FOR CONTROLLING A HYDRAULICALLY ACTUATED DRIVE UNIT OF A VALVE

(71) Applicant: Pleiger Maschinenbau GmbH & Co. KG, Witten (DE)

(72) Inventor: Björn Litschko, Essen (DE)

(73) Assignee: PLEIGER MASCHINENBAU GMBH & CO. KG, Witten (DE)

( * ) Notice: Subject to any disclaimer, the term of this patent is extended or adjusted under 35 U.S.C. 154(b) by 0 days.

(21) Appl. No.: 15/773,842

(22) PCT Filed: Nov. 3, 2016

(86) PCT No.: PCT/EP2016/076543
§ 371 (c)(1),
(2) Date: May 4, 2018

(87) PCT Pub. No.: WO2017/076965
PCT Pub. Date: May 11, 2017

(65) Prior Publication Data

US 2018/0328386 A1 Nov. 15, 2018

(30) Foreign Application Priority Data

Nov. 6, 2015 (DE) ..... 10 2015 119 108

(51) Int. Cl.
*F15B 11/042* (2006.01)
*F15B 11/044* (2006.01)

(52) U.S. Cl.
CPC ..... *F15B 11/0423* (2013.01); *F15B 11/042* (2013.01); *F15B 11/044* (2013.01); *F15B 2211/20515* (2013.01); *F15B 2211/351* (2013.01); *F15B 2211/353* (2013.01); *F15B 2211/40584* (2013.01);
(Continued)

(58) Field of Classification Search
CPC ..... F15B 11/042; F15B 11/0423; F15B 2211/6336; F15B 2211/7052; F15B 2211/75; F15B 2211/20515
See application file for complete search history.

(56) References Cited

U.S. PATENT DOCUMENTS 4,215,844 A * 8/1980 Bowen ..... F15B 1/02 251/28
4,416,187 A * 11/1983 Nystrom ..... F15B 21/087 91/361
(Continued)

FOREIGN PATENT DOCUMENTS

DE 198 01338 C1 6/1999
DE 102007007005 A1 8/2008
(Continued)

*Primary Examiner* — Thomas E Lazo
(74) *Attorney, Agent, or Firm* — Horst M. Kasper, Esq

(57) ABSTRACT

The invention relates to a method for controlling a hydraulically actuated drive unit (1-3), especially for a valve or control device, wherein at least on a part of the displacement of the drive unit the displacement speed (v') is detected and compared with a predetermined target displacement speed (v), whereupon in the case of a difference between actual value (v') and target value (v) of the speed, the controlling of the drive unit (1-3) is changed such that the displacement speed (v') of the drive unit is adapted to the target value (v).

11 Claims, 8 Drawing Sheets

Figure 1:
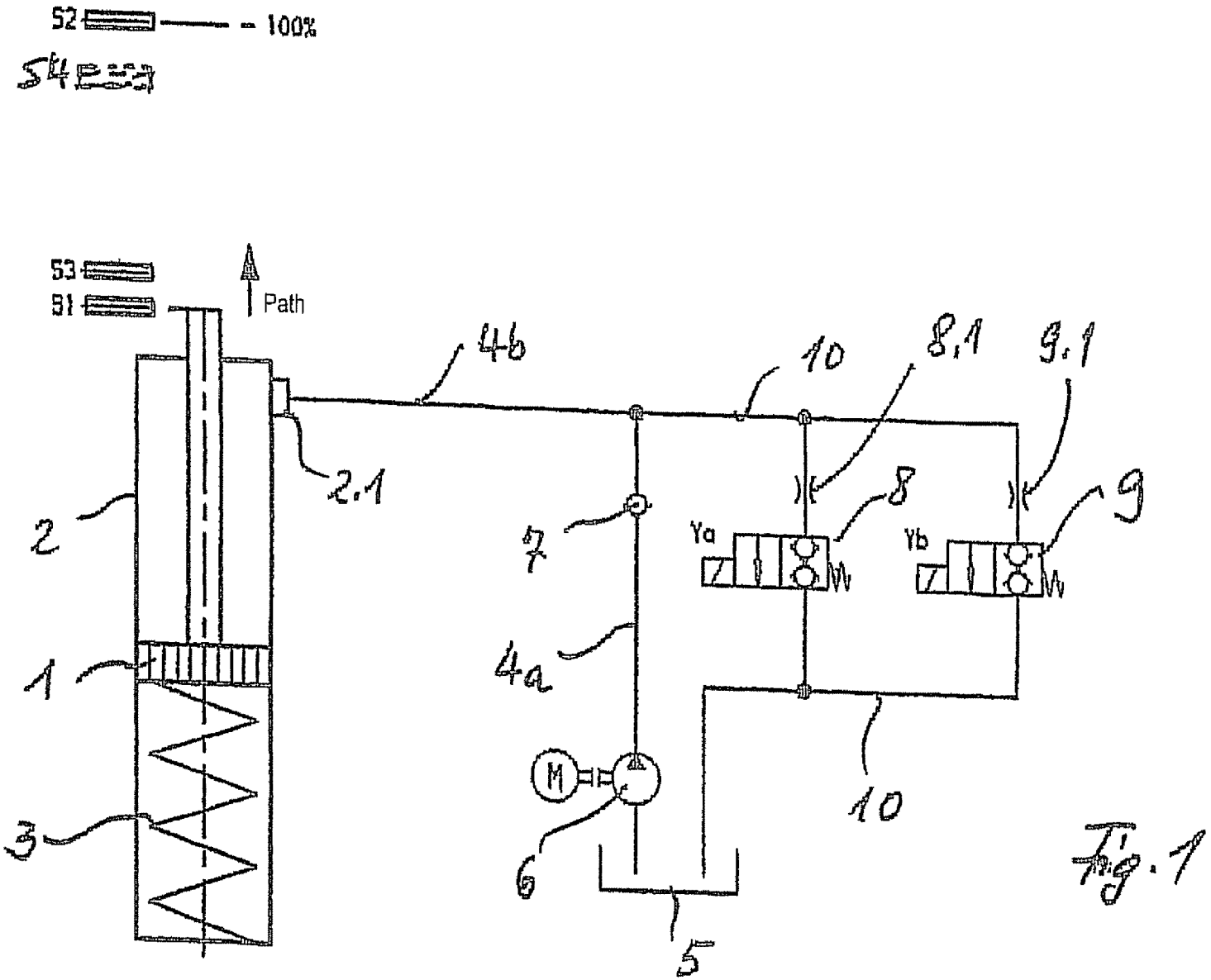

(52) U.S. Cl.
CPC ..... *F15B 2211/40592* (2013.01); *F15B 2211/41509* (2013.01); *F15B 2211/41581* (2013.01); *F15B 2211/455* (2013.01); *F15B 2211/46* (2013.01); *F15B 2211/633* (2013.01); *F15B 2211/6336* (2013.01); *F15B 2211/6651* (2013.01); *F15B 2211/7052* (2013.01); *F15B 2211/7053* (2013.01); *F15B 2211/75* (2013.01)

(56) References Cited

U.S. PATENT DOCUMENTS

| | | | | | |
|---|---|---|---|---|---|
| 4,625,622 | A * | 12/1986 | Gunda | F15B 21/087 | 91/36 |
| 4,642,986 | A * | 2/1987 | Chatelin | F15B 11/126 | 60/473 |
| 4,932,311 | A * | 6/1990 | Mibu | F15B 15/264 | 188/161 |
| 5,584,224 | A * | 12/1996 | Davies | B66B 1/24 | 91/361 |
| 8,240,144 | B2 * | 8/2012 | Vigholm | E02F 9/2207 | 60/431 |
| 9,234,532 | B2 * | 1/2016 | Vanderlaan | F15B 7/006 | |
| 9,360,028 | B2 * | 6/2016 | Zwingler | F15B 11/0423 | |
| 2011/0209471 | A1 * | 9/2011 | Vanderlaan | F15B 7/006 | 60/446 |
| 2015/0040555 | A1 * | 2/2015 | Aneder | F15B 13/028 | 60/464 |
| 2015/0107236 | A1 * | 4/2015 | Udagawa | E02F 9/2095 | 60/430 |

FOREIGN PATENT DOCUMENTS

| | | | | |
|---|---|---|---|---|
| DE | 102015 119 108 | A1 | 5/2017 | |
| EP | 0111637 | A1 * | 6/1984 | F15B 21/087 |
| EP | 0111637 | A1 | 6/1984 | |
| EP | 0322503 | A2 | 7/1989 | |
| EP | 0708250 | A2 | 4/1996 | |
| EP | 123 594 | A1 | 11/2009 | |
| EP | 2636637 | A1 | 9/2013 | |
| WO | WO 981 34868 | A1 | 8/1998 | |
| WO | WO 00114413 | A1 | 3/2000 | |

* cited by examiner

METHOD AND DEVICE FOR CONTROLLING A HYDRAULICALLY ACTUATED DRIVE UNIT OF A VALVE

In the case of hydraulically actuated driving of valves or control devices, for example on ships which travel from arctic regions into subtropical regions, due to a change in the ambient temperature of often over 100° C., the viscosity of the hydraulic fluid changes, so that, through the change in viscosity, a change in the time also occurs within which a valve is moved by means of the hydraulically actuated drive unit, for example from the open into the closed position.

In the case of low temperatures and thus high viscosity, the valve often cannot be moved or displaced quickly enough, while in the case of high temperatures and low viscosity a valve is often moved too quickly, so that pressure surges, so-called hydraulic shocks, can occur in a pipeline in which the valve is incorporated.

However, substantially constant displacement times are important in practice, especially for ship valves which have to operate under very different ambient temperatures.

It is the object of the invention to provide the controlling or triggering of hydraulically actuated drive units, especially of valves, such that independently of changing ambient temperatures substantially always same displacement times are maintained when the valve is displaced. This object and task is solved according to the invention having a method according to claim 1 and by devices having the features of claims 9, 10 and 11.

This object is solved according to the invention especially in that at least on a part of the displacement path of the drive unit, the displacement speed is detected and compared with a predetermined target displacement speed stored in an electronic memory, whereupon after an occurrence of a difference between target value and actual value, the controlling of the drive unit is corrected such that the drive unit moves through the displacement in the predetermined displacement time. According to the invention, the displacement speed can be detected directly via corresponding sensors, or indirectly. The latter can take place, for example, by means of a distance and time measurement.

If the drive unit moves too quickly on the measured part of the displacement, then the displacement speed can be reduced for the further displacement, for example by temporarily stopping the drive unit, while in the case of a too slow displacement movement of the drive unit the displacement speed is increased over the remaining displacement, for example by increased reduction of the pressure of the hydraulic fluid at a spring-loaded piston of the drive unit in each case, in order to achieve the predetermined displacement time over the whole predetermined displacement.

In this way, valves can be displaced independently of the ambient temperature and thus independently of the viscosity in each case, with always same displacement times. Thus a more precise control of such valves is made possible even under extreme ambient conditions.

According to the invention, the displacement time is detected on a partial section of the displacement of the drive unit, and from the speed value obtained in this way, it is calculated how long the drive unit requires to travel through the whole displacement, so that the whole displacement time can already be calculated on the basis of one measurement value. Preferably, the displacement speed is measured at the beginning of the displacement, starting from the end position. However, it is also possible to measure the speed within the displacement on a partial section which starts from an intermediate position of the piston of the drive unit.

The advantage of the intermediate time measurement according to the invention in relation to a temperature measurement for determining the driving speed of the drive unit is that, in the case of the intermediate time measurement, a direct measurement of the displacement time is carried out at the current operating point. By means of a temperature measurement, it would only be possible indirectly to detect the influence of the viscosity of the hydraulic fluid on the displacement times, so series of measurements for different temperatures would have to be detected and the values would have to be stored in the program code of a control device. Moreover, further influences on the displacement time, like, for example, different hydraulic losses, would not be detected in the case of a temperature measurement.

The invention relates to a method according to claim 1 for controlling a hydraulically actuated drive unit, especially for a valve, wherein at least on a part of the displacement path of the drive unit the displacement speed (v') is detected and compared to a predetermined target displacement speed (v), whereupon in the case of a difference between actual value (v') and target value (v) of the speed, the controlling of the drive unit is changed such that the displacement speed (v') of the drive unit is adapted to the target value (v).

According to an advantageous embodiment of the invention, the displacement speed (v') is detected by means of a combination of distance measurement and time measurement of the displacement at at least two measuring points. For example, at two switch points in each case the distance and the time are measured, so that in this way the displacement speed of the known displacement of the valve can be calculated in a simple manner. Thus precise measurement and control is possible with a small technical effort and moderate costs.

According to an advantageous embodiment of the invention, the displacement speed (v') of the drive unit is measured on a partial section (S1 to S3) and is used as a basis for calculating the time for displacement over the remaining displacement.

According to a further advantageous embodiment of the invention, the displacement speed (v') is measured at the beginning of the displacement starting from the end position (S1) on a partial section (S1 to S3).

According to a further advantageous embodiment of the invention, the displacement speed (v') of the drive unit is continuously detected and compared with the predetermined target displacement speed (v), whereupon in the occurrence of a difference between target value and actual value, the controlling of the drive is continuously changed such that the predetermined target displacement time is maintained.

According to a further advantageous embodiment of the invention, for a drive unit having a spring-loaded piston, the hydraulic pressure acting on the piston is controlled by changing the passage cross-section in a return line.

According to a further advantageous embodiment of the invention, for a drive unit having a piston acted on by hydraulic fluid on both piston sides, the hydraulic pressure is controlled by changing the passage cross-section in the pressure-conducting hydraulic line.

According to a further advantageous embodiment of the invention, for an electrohydraulic drive the controlling of the drive unit is controlled by a change in the motor rotational speed or by switching the motor (M) on and off.

The invention likewise relates to a device for controlling a hydraulically actuated drive unit especially of a valve, comprising a piston which is in a hydraulic cylinder and is acted on by a spring, a hydraulic pump for pressure-loading the spring-loaded piston through a feed line, and at least a control valve in a return line for opening and closing the return line, wherein the cross-section of the return line is controllable through a control unit which is connected to a processing unit in which the actual value of the piston speed (v') is compared with a target displacement speed (v) and which outputs a control signal to the control unit.

The invention likewise relates to a device for controlling a hydraulically actuated drive unit especially of a valve, comprising a piston which is in a hydraulic cylinder and acted on by hydraulic fluid on both piston sides, a hydraulic pump for pressurising the piston, a control valve for switching the hydraulic lines leading to the hydraulic cylinder between feed and return line, and a throttle arranged in the feed line between pressure source and control valve, which throttle is bypassed by a bypass line in which a valve for opening and closing the bypass line is disposed, wherein the passage cross-section of the feed line is controllable through a control unit which is connected to a processing unit in which the actual value of the piston speed (v') is compared with a target displacement speed (v) and which outputs a control signal to the control unit.

The invention likewise relates to a device for controlling a hydraulically actuated drive unit, especially of a valve, comprising a hydraulic pump driven by a drive motor (M) for acting on a piston of the drive unit with hydraulic fluid, wherein the drive motor (M) is controllable through a control unit which is connected to a processing unit in which the actual value of the piston speed (v') is compared with a target displacement speed (v) and which outputs a control signal to the control unit for synchronised operation manner of the motor (M) or for changing the rotational speed of the motor (M).

According to an advantageous embodiment of the device, path-dependent switches (S1 to S4) are provided on at least a partial section of the displacement for detecting the displacement speed of the drive unit.

According to a further advantageous embodiment of the device, the displacement of the drive unit is detected by a potentiometer.

Figure 2:
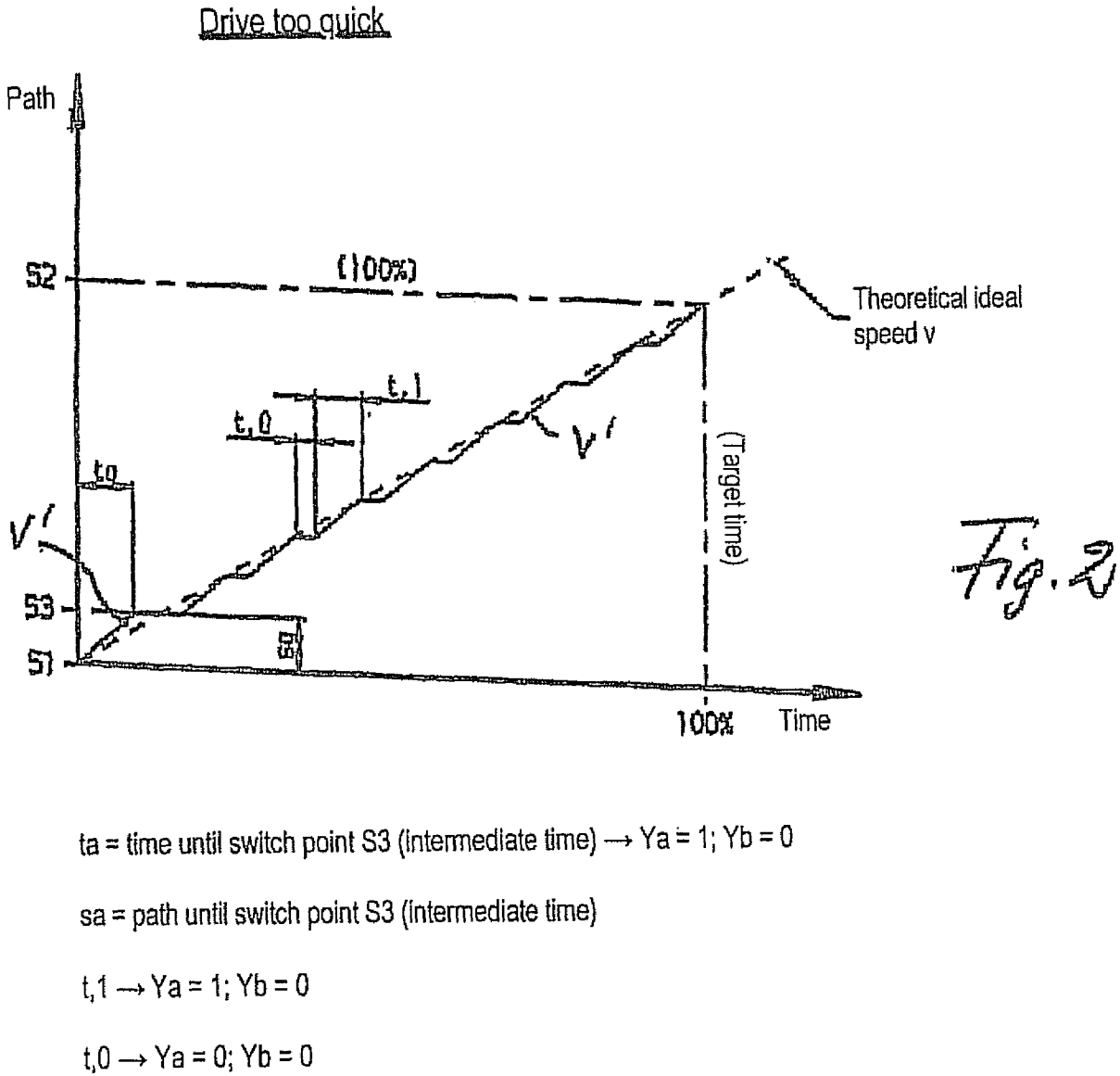
Figure 3:
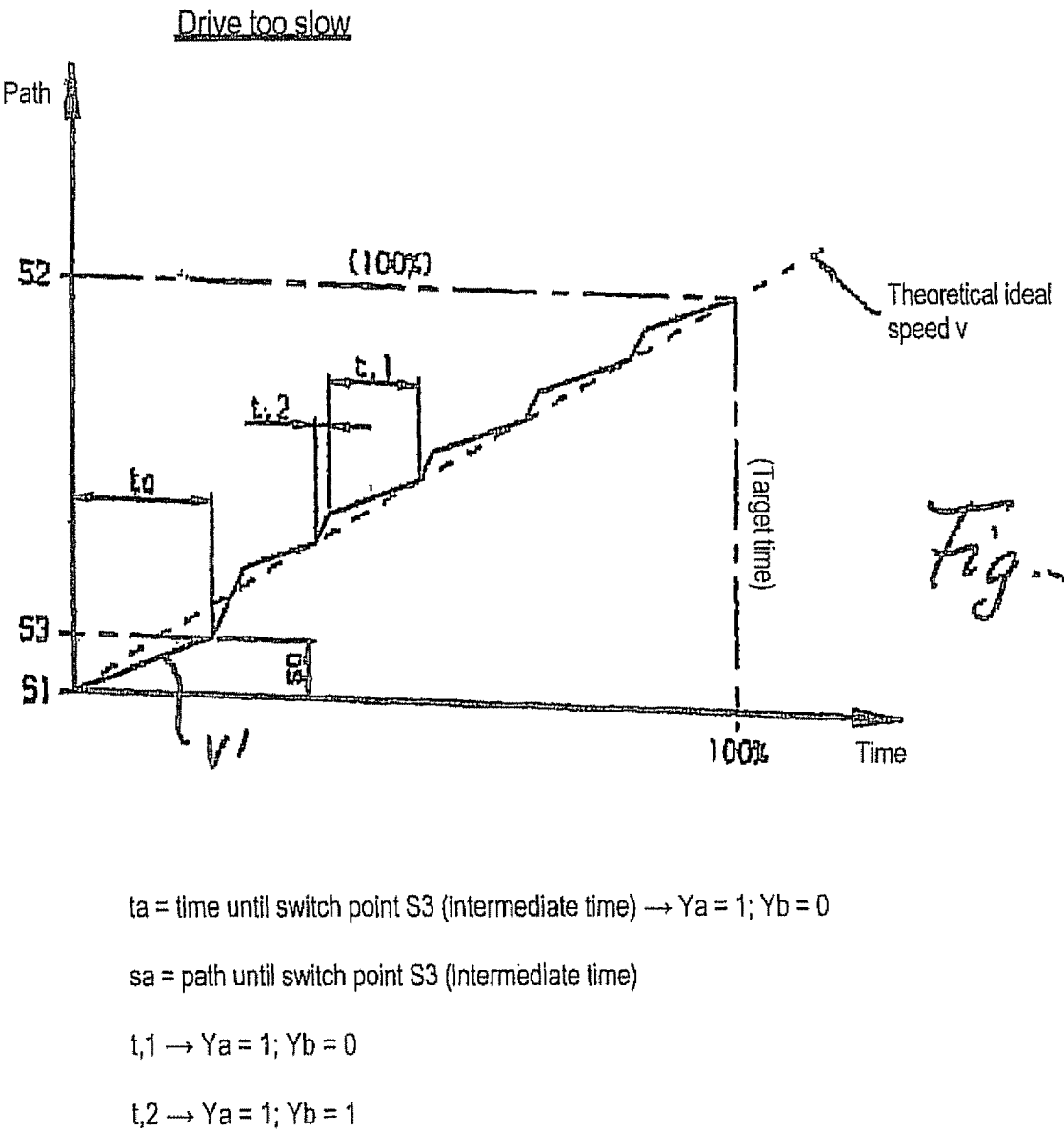
Figure 4:
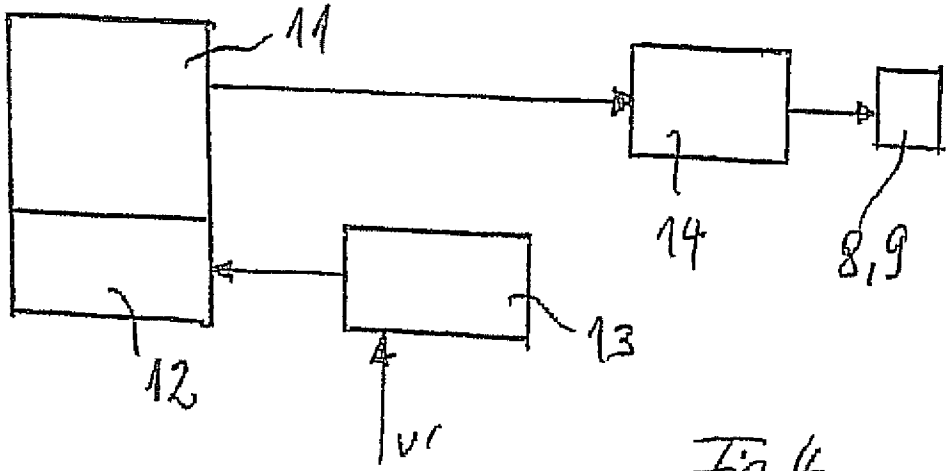
Figure 5:
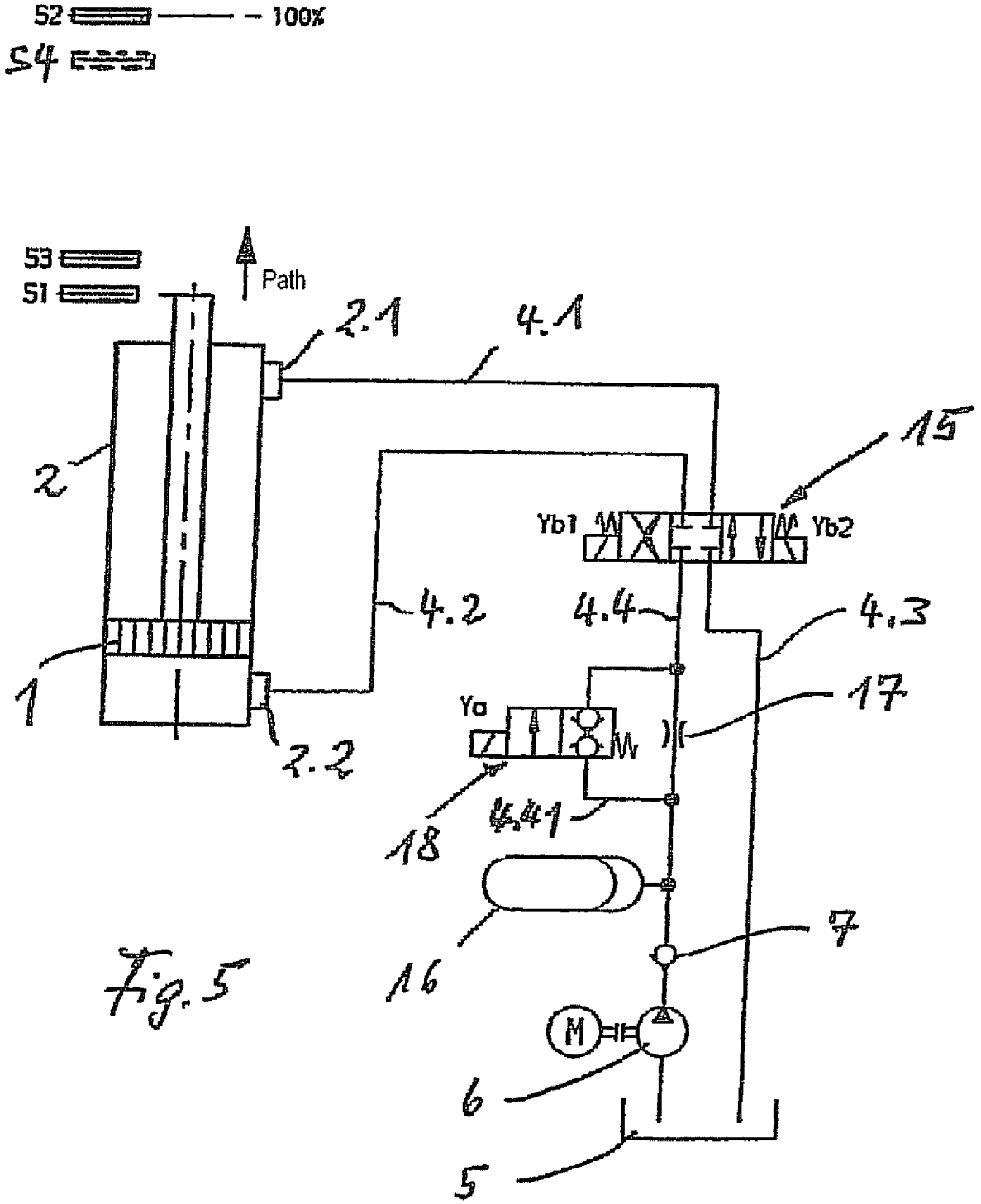
Figure 6:
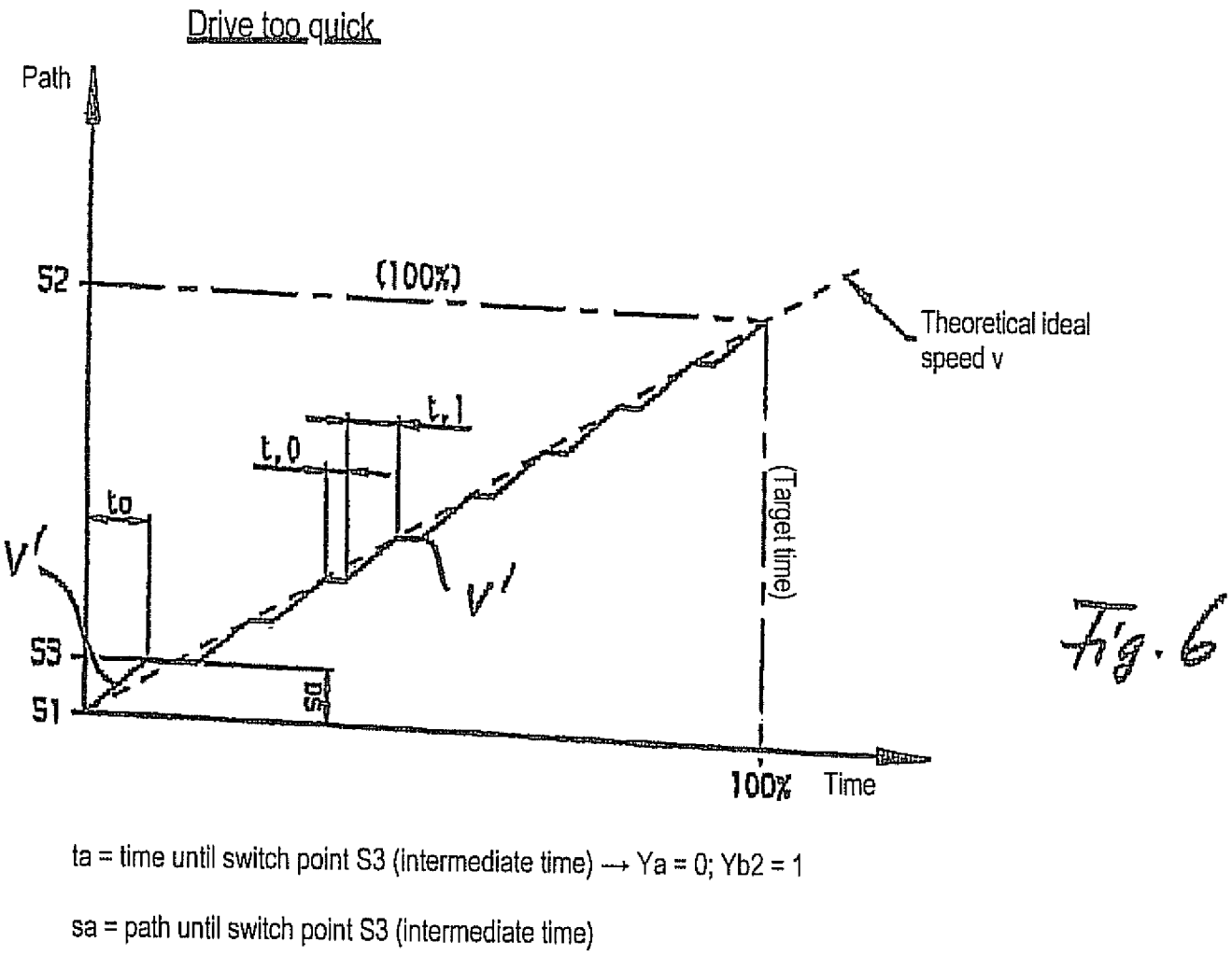
Figure 7:
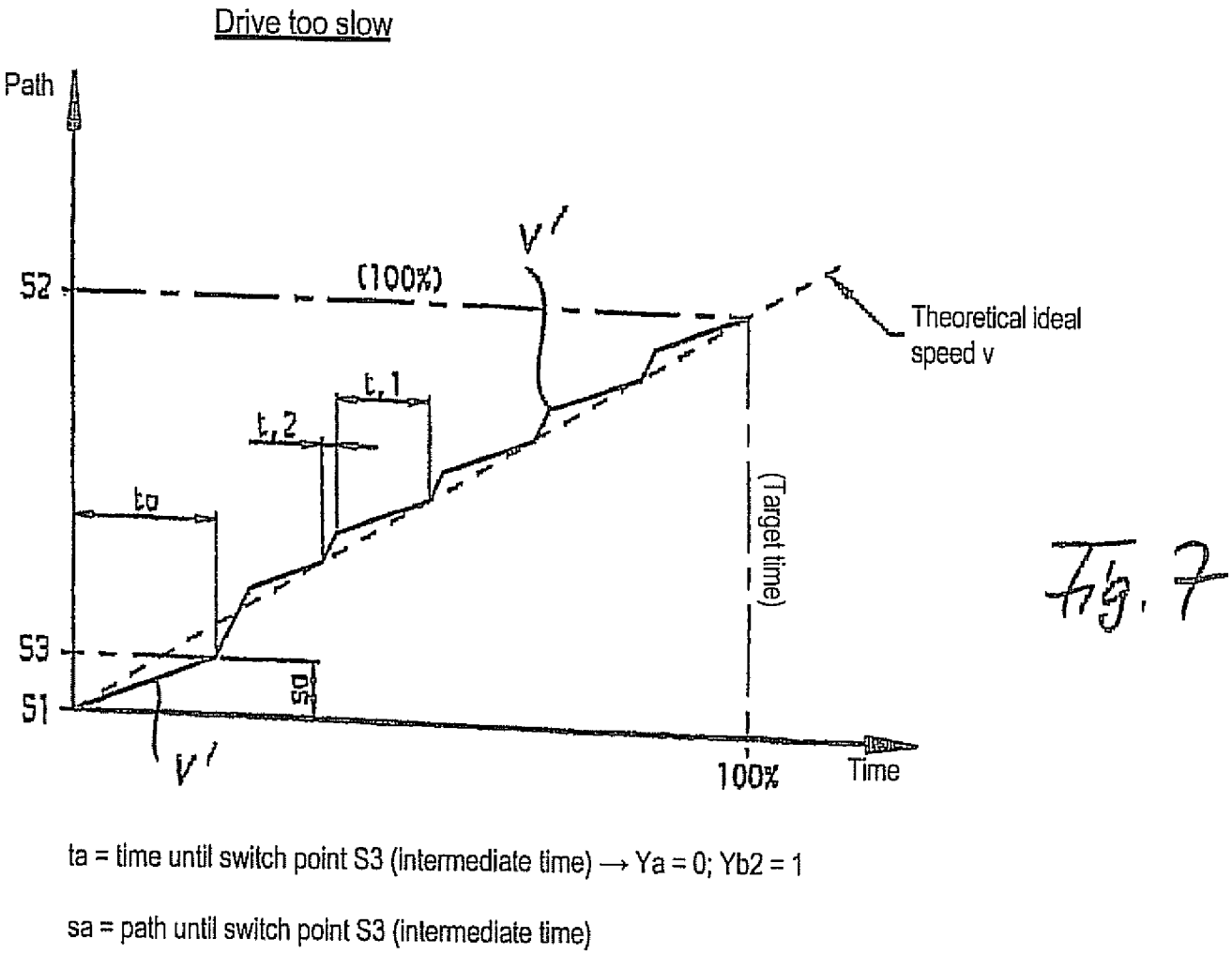
Figure 8:
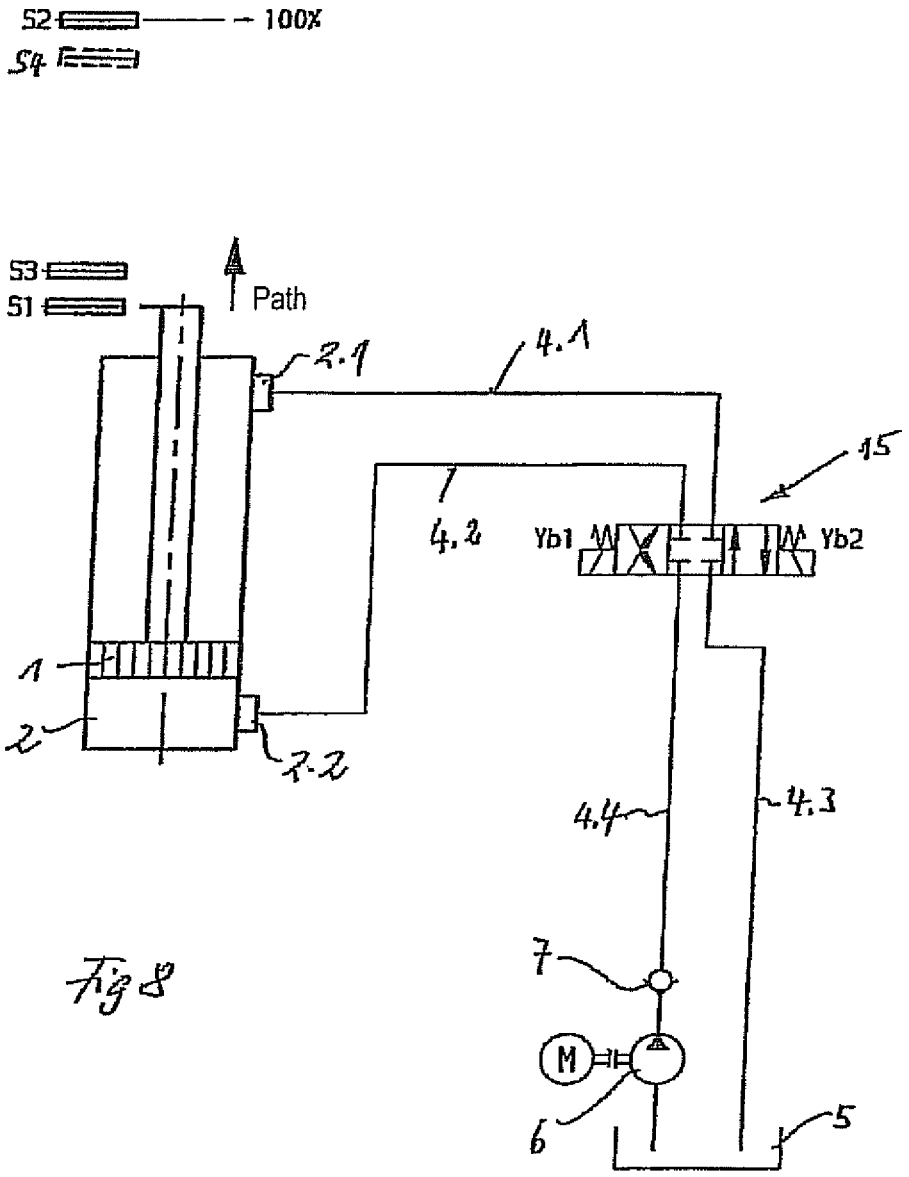

In the following, an exemplary embodiment of the invention is described in detail with reference to the drawing, in which FIG. 1 shows a schematic view of the controlling of a drive unit having a spring-loaded piston for a valve (not shown), FIG. 2 shows, in a diagram, the detection and correction of the displacement time in the case of a drive unit operating too quickly, FIG. 3 shows a diagram corresponding to FIG. 2 in the case of a drive unit operating too slowly, FIG. 4 shows a schematic representation of a controlling means having a control unit, FIG. 5 shows a view corresponding to FIG. 1 of a drive unit having a piston acted on, on both sides, by hydraulic fluid, and FIGS. 6 and 7 show diagrams corresponding to FIGS. 2 and 3 of the controlling of the drive unit in FIG. 5, and FIG. 8 shows a further embodiment.

FIG. 1 shows a piston 1 in a cylinder 2, wherein on one side the piston 1 is acted on by a spring 3 and on the opposite side of the piston 1 the pressure of a hydraulic fluid abuts at the connection 2.1 which holds the piston 1 against the force of the spring 3 in a displaced position. By changing the pressure of the hydraulic fluid, the piston 1 is displaced against the force of the spring 3 or by means of the spring 3.

In this embodiment, the piston 1 acted on by the spring 3 in the cylinder 2 forms a drive unit, which displaces a valve (not shown), for example, swivels a door in a pipeline.

In the embodiment shown, the displacement to be travelled by the piston 1 extends in FIG. 1 from S1 to S2, wherein S2 corresponds to 100% of the displacement starting from S1.

From S1 to S3, a partial section of the displacement is given; S1 corresponds for example to the open position of the valve and S2 to the closed position.

The cylinder 2 is acted on by a feed line 4*a* and 4*b* with hydraulic fluid from a reservoir 5 through a pump 6 driven by a motor M. Reference sign 7 designates a return valve in the line portion 4*a*.

Reference signs 8 and 9 designate control valves in a return line 10 extending to the reservoir 5 in parallel circuit. By 8.1 and 9.1, a throttle, which can be optionally provided, is connected in series before the control valve in each case.

In the switch position shown, a pressure built up through the pump 6 in the feed line 4*b* is maintained, because the two control valves 8 and 9 are closed and the return valve 7 prevents a return flow. By means of switching one of the two control valves or both valves, the passage cross-section can be released from the feedline 4*b* to the reservoir 5 via the return line 10, so that the pressure in the feed line 4*b* is reduced and the piston 1 can be displaced by means of the spring 3 into the displacement position indicated by an arrow.

The control valves 8 and 9 are represented as electrically controllable two-way valves. It is also possible to provide another construction of valves, in order to control the controlling of the drive unit from the members 1 to 3, described in the following.

In the embodiment shown, the piston 1 is moved in the direction of the arrow through the spring 3, as soon as the pressure of the hydraulic fluid is reduced by opening one of the control valves 8 or 9.

FIG. 2 shows in a diagram the displacement S of the piston 1 over the displacement time t, wherein by means of a dashed line the theoretically ideal target displacement speed v is represented, with which the piston 1 travels through the predetermined target displacement from S1 to S2 in the predetermined target displacement time 1=100%.

The target displacement time is predetermined especially taking account of the type of the valve driven by the drive unit and of the fluid to be controlled through the valve, for example of a door in a pipeline which is swivelled through the piston 1 of the drive unit over a predetermined angle of rotation by means of rotating a toothed gear by means of a toothed rack displaced by the piston.

As an example, in FIG. 2, after a predetermined unit of time to and after a travelled part sa of the displacement from S1 to S3, preferably starting from the end position by S1 at the beginning of the displacement, the speed of the piston 1 is measured, whereupon the measured piston speed v' is compared with the target speed v stored in a storage unit and it is determined that the drive is operating too quickly and the piston 1 is being moved too quickly, because for example by means of high ambient temperatures the viscosity of the hydraulic fluid is low. In order to correct the too quick operation manner of the drive unit, for example the control valve 8 and/or 9, by S3, is closed, wherein the drive is stopped, by S3, for a predetermined time, as is shown by a horizontal course of the piston speed v'.

After a stop time determined by the processing unit, one of the control valves 8, 9 is opened again so that the piston 1 is moved along a further partial section by the force of the spring 3, whereupon a synchronised controlling of the drive unit corresponding to the steps predetermined by the processing unit is repeated, as represented by the step-like line of the piston speed v' in FIG. 2. Here, the stop time can change from step to step. Likewise, the displacement time can change according to the result of the calculation in the processing unit along the length of a partial section of the displacement, especially when a further review of the piston speed takes place on a further intermediate section.

FIG. 3 shows the controlling of the drive unit in the case of a drive operating too slowly. A measurement value of the displacement time ta on reaching S3 of the displacement through the piston 1 results in a too slow operation of the drive in this example, after a comparison with the theoretically ideal speed v. By means of an increased pressure reduction of the hydraulic fluid in the feed line 4*b* by means of corresponding enlargement of the passage cross-section by means of opening both control valves 8 and 9, in the case of high viscosity of the hydraulic fluid the pressure in the cylinder 2 can be reduced more quickly, so that a greater displacement from the piston 1 can be travelled per unit of time, as the steeper line of the piston speed v' after ta in FIG. 3 shows.

In the case of the embodiment shown in FIGS. 2 and 3, the drive unit is controlled by means of synchronised opening and closing of one or both control valves 8, 9 such that a predetermined target displacement time for a predetermined displacement is maintained, wherein the piston speed v' on a partial section is measured and compared with the target value v, whereupon in the case of a difference between actual value and target value, the controlling of the drive unit is changed such that the predetermined target displacement time is maintained.

Instead of two control valves 8 and 9, which serve to enlarge the passage cross-section for the hydraulic fluid in the case of pressure reduction in the cylinder 2, a single control valve can also be provided, by means of which the passage cross-section in the return line 10 can be adjusted to be larger or smaller.

It is also possible that the control valves 8 and 9 have a differently large passage cross-section, so that the pressure reduction at the piston 1 can be differently controlled when the one or other control valve is opened.

The measurement of the displacement time can take place, for example, by means of three path-dependent switches. A switch is provided in each case in the end position S1 and S2.

The third switch, by S3, serves for detecting the displacement time from S1 to S3 as a basis for calculation. As soon as the piston speed v' between S1 and S3 is detected by the processing unit, this measured piston speed and displacement speed can be used for the calculation of the displacement time over the remaining displacement.

In the embodiment shown, the displacement time t=100% of the drive unit for low temperatures, that is high viscosity, is preset. The presettting can also be performed in the case of higher temperatures. In order for a constant displacement time to be obtained in the case of higher temperatures, during the closing of the valve in the direction of the arrow in FIG. 2, the displacement time and displacement speed are measured with the third position switch, by S3, whereupon by means of the corresponding calculation in the processing unit the control valves 8, 9 are closed and opened in a synchronised manner.

For opening the valve by means of a displacement of the piston 1 against the force of the spring 3, the pressure build-up in the cylinder 2 can be controlled differently through the pump 6.

In the embodiment according to FIGS. 1 to 3, the drive unit is controlled in a synchronised manner only during the stroke of the piston in the direction of the arrow in FIG. 1.

When the stroke of the piston is also to be travelled through in the opposite direction, that is, against the force of the spring 3 in a predetermined target displacement time, then starting from the end position S2, a position switch S4, indicated in FIG. 1 by dashed lines, is provided at a small distance, by means of which the displacement speed v' of the piston 1 in the opposite direction is detected.

When the displacement speed of the piston 1 differs from the target displacement speed v, by means of increased rotational speed of the drive motor M, through the pump 6, pressure can be built up more quickly in the cylinder 2 in order to displace the piston 1 more quickly against the force of the spring 3 toward end position S1. In a corresponding way, by means of a lower rotational speed of the motor M or a synchronised switching-off of the motor M, a slower displacement of the piston 1 in the opposite direction can be obtained.

Instead of the detection of the piston speed and displacement speed v' on a partial section of the displacement (FIGS. 2 and 3), the displacement speed v' can also be continuously measured and continuously compared with the predetermined target displacement speed v. Here, the control valve (or, if required, a plurality of control valves) provided for the controlling of the drive unit is continuously actuated, in order to keep the piston speed v' closer to the theoretical target displacement speed v.

By way of example, a continuously adjustable throttle can be provided in a control valve 8 or 9, in order to continuously change the cross-section of flow.

An alternative detection of displacement time can take place by means of a continuous distance measurement at the drive unit, for example by means of a potentiometer through which the displacement over the whole displacement distance from S1 to S2 is recorded.

It is also possible, for electrohydraulic systems, to control the electric motor M used there which drives the hydraulic pump 6, in a correspondingly synchronised manner, as was described above for the moving back of the piston 1 into the end position, by S1, for the drive unit in FIG. 1.

FIG. 4 shows schematically, as an example, a processing unit 11 having a store 12 in which the target displacement speed v, which is predetermined for the valve in each case, is stored. By means of a comparing unit 13, the measured displacement speed v' is compared with the target displacement speed v, whereupon in the case of a difference it is detected by the processing unit 11 how the drive is corrected in the case of too quick operation by stopping the piston movement, and in the case of operating too slowly, by enlarging the pressure reduction.

The processing unit 11 outputs a control signal to a control unit 14, which correspondingly controls the control valves 8, 9.

In the embodiment in FIG. 1, a spring-loaded piston 1 is represented in a cylinder 2 as drive unit.

The synchronised controlling according to the invention is possible in the same way for a piston of a drive unit, acted on by hydraulic fluid on both piston sides.

FIG. 5 shows, in a view corresponding to FIG. 1, a piston 1 of the drive unit acted on by hydraulic fluid on both piston sides. Reference signs 2.1 and 2.2 designate connections of hydraulic lines 4.1 and 4.2, which are controlled by a common control valve 15. In the shown switch position of the control valve 15, which can be formed as an electromagnetically actuated 4-way valve, the two hydraulic lines 4.1 and 4.2 are blocked, so that the piston 1 is held in its position.

In the schematically shown switch position Yb1 of the control valve 15, the hydraulic line 4.2 is communicated with the portion of line 4.3, so that the pressure on the bottom side of the piston 1 is reduced and hydraulic fluid is supplied into the reservoir 5, while the portion of line 4.4 with the pump 6 is communicated with the hydraulic line 4.1, so that hydraulic fluid which is under pressure abuts at the connection 2.1.

In the switch position Yb2 of the control valve 15, the portion of line 4.3 is communicated with the hydraulic line 4.1 and the portion of line 4.4 is communicated with the line 4.2, wherein the direction of the arrow shows the direction of flow of the hydraulic fluid.

The pump 6 is arranged with the return valve 7 in the portion of line 4.4 between control valve 15 and reservoir 5. Reference sign 16 designates a pressure reservoir. During normal operation, in the case of pressure build-up in the cylinder 2, pressure from the pressure reservoir 16 is guided to one of the connections 2.1 and 2.2, so that the pump 6 does not have to operate in the case of every pressurisation of the piston 1.

After a determined pressure reduction in the pressure reservoir 16, the pressure of the hydraulic fluid in the pressure reservoir 16 is built up again by means of the pump 6.

Furthermore, a throttle 17 is arranged in this portion of line 4.4, which throttle is bypassed by means of a bypass passage 4.41 in which a valve 18 is arranged which in its configuration corresponds to one of the valves 8 and 9 in FIG. 1.

In the shown switch position of the valve 18, the bypass line 4.41 is closed, so that in the case of switching of the control valve 15 into one of the positions Yb1 or Yb2, pressure of the hydraulic fluid reaches the cylinder 2 via the throttle 17.

In the switch position Ya of the valve 18, the throttle 17 is bypassed, so that the hydraulic pressure of the pressure reservoir 16 reaches the cylinder 2 directly via the full passage cross-section.

At the times t,1 and t,0 the valve 18 in the shown position in FIG. 5 is closed (Ya=0), while in the time t,1 the control valve 15 is located in the position Yb2=1 and, at t,0, in the blocked position (Yb2=0) shown in FIG. 5.

FIG. 6 shows, corresponding to FIG. 2, the course of the speed v' of the piston 1, wherein to represents the time until reaching the switch point S3 at the end of the part sa of the displacement between S1 and S3.

FIG. 7 shows, corresponding to FIG. 3, the switching processes at the control valve 15 and 18 in the case of a too slow drive. At the time t,2 the valve 18 is in the open position (Ya=1), while the control valve 15 is located in the switch position Yb1=1.

In other words, in the case of too-quick drive in FIG. 6, over the time period t,0 the switching state shown in FIG. 5 at the valves 15 and 18 is maintained, while over the time t,1 the two hydraulic lines 4.1 and 4.2 are in the switch position Yb2, so that pressure is guided via the throttle 17 into the hydraulic line 4.2.

In a corresponding way, in the case of too-slow drive in FIG. 7, the throttle 17 is bypassed during the time t,2 in order to increase the pressure on the bottom side of the piston 1, while over the time period t,1 the valve 18 is closed and the pressure build-up takes place over the cross-section of flow of the throttle 17.

In the embodiment of FIG. 1 with spring-loaded piston 1, the drive unit is controlled in a synchronised manner by means of valve control in the return line 10, while for the embodiment in FIG. 5 having piston 1 acted on, or pressurised, on both sides, a change in passage cross-section in the feed line 4.4 is provided.

Here, the stroke of the piston is controlled stepwise only in the direction of the arrow in FIGS. 1 and 5.

When the stroke of the piston is to be travelled through against the displacement shown by the arrow in FIGS. 1 and 5 likewise in a predetermined displacement time, then starting from the end position S2 a further switch S4 is provided on a partial section, in order to detect the piston speed on the return path.

As described by means of FIG. 1, the displacement time of the piston 1 can be changed by changing the pressure load in the feedline.

Instead of the valve control shown on the one hand in the return line in FIG. 1 and on the other hand in the feed line in FIG. 5, for an electrohydraulic drive the motor M of the pump 6 can be controlled in a synchronised manner, in order to maintain a predetermined displacement time of the piston 1.

In the arrangement in FIG. 5, the pressure reservoir 16 and the valve 18 and the throttle 17 can be omitted here, as FIG. 8 shows, wherein by means of synchronised operation of the pump 6 in FIG. 8 by means of switching the motor M on and off, both stroke paths of the piston 1 can be controlled in a synchronised manner, in each case according to the position of the control valve 15.

Instead of the shown number of controlling steps in FIGS. 2, 3 and FIGS. 6, 7, fewer or more steps can also be provided. Theoretically, only a step of stopping the piston movement and the piston acceleration could also be provided, in order to adapt the displacement time of the piston 1 over the whole displacement to a predetermined displacement time.

In the Figures, the individual steps of the synchronised controlling of the drive unit are shown in equal time intervals t. However, it is also possible to adjust the steps to have different lengths along the displacement, in order to travel through the whole displacement in the predetermined displacement time.

The described correction of the displacement speed of the drive unit is preferably performed at each displacement of the valve, so that the displacement speed of the drive unit is adapted in each case to the current conditions.

The correction of the displacement time of a hydraulically actuated drive unit can also be used in other areas than the actuation of valves especially on ships. For example, the drive unit controlled in a synchronised manner according to the invention can also actuate a lever mechanism which has to carry out a predetermined displacement in a predetermined time.

The invention claimed is:

1. Method for controlling a hydraulically actuated drive unit (1-3), with a predetermined displacement, for a valve or control device, wherein at least on a part of the displacement of the drive unit the displacement speed (v') is detected and compared with a predetermined target displacement speed (v) by means of a combination of distance measurement and time measurement of the displacement at at least two measuring points, whereupon in the case of a difference between actual value (v') and target value (v) of the speed, the controlling of the drive unit (1-3) is changed such that the displacement speed (v') of the drive unit is adapted to the target value (v), so that the drive unit (1-3) travels the displacement in a predetermined, constant displacement time, wherein the displacement speed (v') of the drive unit (1-3) is measured on a partial section (S1 to S3) and used as a basis for calculating the time for displacing over the remaining displacement path for satisfying the predetermined displacement time.

2. Method according to claim 1, wherein the displacement speed (v') at the beginning of the displacement is measured on a partial section (S1-S3) starting from the end position (S1).

3. Method according to claim 1, wherein the displacement speed (v') of the drive unit (1-3) is detected continuously and compared with the predetermined target displacement speed (v), whereupon in the occurrence of a difference between target value and actual value the controlling of the drive is continuously changed such that the predetermined target displacement time is maintained.

4. Method according to claim 1, wherein for a drive unit having a spring-loaded piston (1), the hydraulic pressure acting on the piston is controlled by changing the passage cross-section in a return line (10).

5. Method according to claim 1, wherein for a drive unit having a piston (1) acted on by hydraulic fluid on both piston sides, the hydraulic fluid is controlled by changing the passage cross-section in the pressure-conducting hydraulic line (4.4).

6. Method according to claim 1, wherein for an electro-hydraulic drive the controlling of the drive unit is controlled by means of a change in the motor rotational speed or by means of switching on and off of the motor (M).

7. Device for controlling a hydraulically actuated drive unit, of a valve, comprising a piston (1) spring-loaded by a spring (3) in a hydraulic cylinder (2), with a predetermined displacement, a hydraulic pump (6) for pressurising the spring-loaded piston (1) through a feed line (4), and at least a control valve (8, 9) in a return line (10) for opening and closing a cross-section of the return line, wherein the cross-section of the return line (10) is controllable through a control unit (14) which is connected to a processing unit (11) in which a predetermined displacement time for the displacement is stored and which is configured to compare, the actual value of the piston speed (v') with a target displacement speed (v) and which is configured to output a control signal to the control unit (14) such that the predetermined displacement time is satisfied.

8. Device according to claim 7, wherein for detecting the displacement speed of the drive unit, path-dependent switches (S1 to S4) are provided on at least a partial section of the displacement path.

9. Device according to claim 7, wherein the displacement of the drive unit is detected by means of a potentiometer.

10. Device for controlling a hydraulically actuated drive unit, a valve, comprising a piston (1) acted on by hydraulic fluid on both piston sides in a hydraulic cylinder (2) with a predetermined displacement, a hydraulic pump (6) for pressurising the piston (1), a control valve (15) for switching the hydraulic lines (4.1, 4.2) leading to the hydraulic cylinder (2) between feed line and return line, and a throttle (17) arranged in the feed line between pressure source (6, 16) and control valve (15), which throttle is bypassed by a bypass line (4.41) in which a valve (18) is arranged for opening and closing the bypass line, wherein the passage cross-section of the feed line (4.4) and the valves (15,18) are controllable through a control unit (14), which is connected to a processing unit (11) in which a predetermined displacement time for the displacement is stored and which is configured to compare the actual value of the piston speed (v') with a target displacement speed (v), and which is configured to output a control signal to the control unit (14) such that the predetermined displacement time is satisfied.

11. Device for controlling a hydraulically actuated drive unit, a valve, comprising a hydraulic pump (6) driven by a drive motor (M) for acting on a piston (1) of the drive unit having a predetermined displacement with hydraulic fluid, wherein the drive motor (M) is controllable through a control unit (14), which is connected to a processing unit (11) in which a predetermined displacement time for the displacement is stored and which is configured to compare the actual value of the piston speed (v') with a target displacement speed (v) and which output is configured to a control signal to the control unit (14), for synchronised operation manner of the motor (M) or for a change in the rotational speed of the motor (M) so that the predetermined displacement time is satisfied.

* * * * *